US010917727B2

(12) United States Patent
Littrell et al.

(10) Patent No.: US 10,917,727 B2
(45) Date of Patent: Feb. 9, 2021

(54) TRANSDUCER SYSTEM WITH CONFIGURABLE ACOUSTIC OVERLOAD POINT

(71) Applicant: Vesper Technologies, Inc., Boston, MA (US)

(72) Inventors: Robert Littrell, Boston, MA (US); Ronald Gagnon, Boston, MA (US)

(73) Assignee: Vesper Technologies, Inc., Boston, MA (US)

( * ) Notice: Subject to any disclaimer, the term of this patent is extended or adjusted under 35 U.S.C. 154(b) by 0 days.

(21) Appl. No.: 16/353,589

(22) Filed: Mar. 14, 2019

(65) Prior Publication Data

US 2019/0289405 A1 Sep. 19, 2019

Related U.S. Application Data

(60) Provisional application No. 62/643,865, filed on Mar. 16, 2018.

(51) Int. Cl.
*H04R 3/00* (2006.01)
*H04R 19/04* (2006.01)
(Continued)

(52) U.S. Cl.
CPC ..... *H04R 19/04* (2013.01); *H04R 1/04* (2013.01); *H04R 3/00* (2013.01); *H04R 17/02* (2013.01);
(Continued)

(58) Field of Classification Search
CPC . H04R 19/04; H04R 1/04; H04R 3/00; H04R 17/02; H04R 19/005
See application file for complete search history.

(56) References Cited

U.S. PATENT DOCUMENTS

2010/0310096 A1* 12/2010 Josefsson ..... H04R 3/06 381/113
2012/0250909 A1 10/2012 Grosh et al.
(Continued)

FOREIGN PATENT DOCUMENTS

WO 2017-059927 A1 4/2017

OTHER PUBLICATIONS

International Searching Authority—International Search Report for International Application No. PCT/US19/22271, dated Jul. 29, 2019, together with the Written Opinion of the International Searching Authority, 17 pages.

*Primary Examiner* — Simon King
(74) *Attorney, Agent, or Firm* — Nutter McClennen & Fish LLP

(57) ABSTRACT

A MEMS transducer system has a transducer configured to convert a received signal into an output signal for forwarding by a transducer output port, and an integrated circuit having an IC input in communication with the transducer output port. The IC input is configured to receive an IC input signal produced as a function of the output signal. The system also has a dividing element coupled between the IC input and the transducer output port. The dividing element is configured to selectively attenuate one or more signals into the IC input to at least in part produce the IC input signal. Other implementations may couple a feedback loop to the ground of the transducer (similar to bootstrapping), or pick off voltages at specific portions of the transducer.

18 Claims, 7 Drawing Sheets

(51) Int. Cl.
*H04R 17/02* (2006.01)
*H04R 1/04* (2006.01)
*H04R 19/00* (2006.01)

(52) U.S. Cl.
CPC ..... *H04R 19/005* (2013.01); *H04R 2201/003* (2013.01)

(56) References Cited

U.S. PATENT DOCUMENTS

2013/0294622 A1* 11/2013 Kasai ..... B81B 3/0021 381/162
2014/0010374 A1* 1/2014 Kasai ..... H04R 31/00 381/26
2014/0086433 A1* 3/2014 Josefsson ..... H04R 3/06 381/98
2015/0124981 A1 5/2015 Veneri et al.
2015/0350792 A1 12/2015 Grosh et al.
2016/0037257 A1 2/2016 Josefsson
2016/0087596 A1* 3/2016 Yurrtas ..... H04R 1/04 381/111
2016/0091526 A1 3/2016 Goda et al.
2016/0134975 A1* 5/2016 Kuntzman ..... H04R 19/005 381/113
2016/0157017 A1* 6/2016 Lesso ..... H04R 19/005 381/71.7
2017/0279425 A1* 9/2017 Valli ..... H03F 3/45475
2017/0347174 A1* 11/2017 Chandrasekaran .... H04R 19/04
2018/0063644 A1* 3/2018 Bach ..... H04R 3/06
2018/0149537 A1* 5/2018 Vizas ..... G01H 9/006

* cited by examiner

TRANSDUCER SYSTEM WITH CONFIGURABLE ACOUSTIC OVERLOAD POINT

PRIORITY

This patent application claims priority from provisional U.S. patent application No. 62/643,865, filed Mar. 16, 2018, entitled, "TRANSDUCER SYSTEM WITH CONFIGURABLE ACOUSTIC OVERLOAD POINT," and naming Robert Littrell and Ronald Gagnon as inventors, the disclosure of which is incorporated herein, in its entirety, by reference.

FIELD OF THE INVENTION

Illustrative embodiments of the invention generally relate to transducers and, more particularly, illustrative embodiments of the invention relate to improving the dynamic range of a transducer.

BACKGROUND OF THE INVENTION

A micro-electro-mechanical system (MEMS) acoustic transducer/sensor coverts acoustic energy into electrical signal, and/or converts an electrical signal into acoustic energy. An example of a MEMS acoustic transducer is a MEMS microphone, which converts sound pressure into an electrical voltage. Based on their transduction mechanisms, MEMS microphones can be made in various forms, such as capacitive microphones or piezoelectric microphones.

MEMS capacitive microphones and electret condenser microphones (ECMs) currently dominate the consumer electronics market. Piezoelectric MEMS microphones, however, occupy a growing portion of the consumer market, and have unique advantages compared to their capacitive counterparts. Among other things, piezoelectric MEMS microphones do not have a back plate, eliminating the squeeze film damping, which is an intrinsic noise source for capacitive MEMS microphones. In addition, piezoelectric MEMS microphones are reflow-compatible and can be mounted to a printed circuit board (PCB) using typical lead-free solder processing, which could irreparably damage typical ECMs.

Transducers have standard metrics, such as the well-known acoustic overload point. Meeting these specifications has proven challenging.

SUMMARY OF VARIOUS EMBODIMENTS

In accordance with one embodiment of the invention, a MEMS transducer system has a transducer configured to convert a received signal into an output signal. The transducer further has an output port for forwarding the output signal. The system also has an integrated circuit ("IC") with an IC input in electric communication with the transducer output port. The IC input is configured to receive an IC input signal produced as a function of the output signal. In addition, the system has an attenuator coupled between the IC input and the transducer output port. The attenuator is selectably actuatable and configured to selectively attenuate one or more signals into the IC input to at least in part produce an attenuated IC input signal. The attenuator may be integral with the integrated circuit or separate from the integrated circuit.

Among other things, the attenuator may include a dividing element, which is selectably actuatable and coupled between the IC input and the transducer output port. The dividing element may include, for example, at least one attenuation branch. Each such attenuation branch preferably has a switch and a capacitance (e.g., one or more capacitors) in series with the switch. More specifically, the dividing element may include a plurality of attenuation branches that each has a switch and a capacitance in series with the switch. The integrated circuit may have a mode pin configured to actuate the at least one attenuation branch when receiving a first signal, and to disable the at least one attenuation branch when receiving a second signal. The system also may have memory configured to store information for selectably actuating prescribed attenuation branches.

Among other things, the transducer may be at least one of a microphone, speaker, accelerometer, tilt sensor (e.g., implemented as a low-G accelerometer) gyroscope, inertial sensor, chemical sensor, pressure sensor, and/or ultrasonic transducer. For example, the transducer may include a MEMS device, such as a MEMS piezoelectric microphone.

The integrated circuit preferably includes an application specific integrated circuit with an operational amplifier having a non-inverting input and an op-amp output. In that case, the IC input may be coupled with the non-inverting input, and have an output coupled with the op-amp output. Moreover, the dividing element may be coupled with a node connecting the IC input and transducer output port and, as such, be electrically in parallel with the transducer output port.

The transducer and integrated circuit of this and other embodiments discussed below each may be part of the same die. Alternatively, the transducer and integrated circuit of this and other embodiments discussed below each may be formed on different dies (e.g., a transducer die and an integrated circuit die).

For some embodiments, the transducer has a plurality of sense members configured to independently move in response to a pressure signal to produce a plurality of member signals. The attenuator is electrically coupled with at least one of the sense members and is configured to selectively electrically couple fewer than all of the member signals with the IC input.

In accordance with another embodiment, a MEMS microphone has a plurality of sense members configured to flex in response to an acoustic signal incident on the sense members. The plurality of the sense members are electrically coupled with a first pad and a second pad. The microphone also has a plurality of nodes between the sense members, and at least one pick-off pad. Each of the pick-off pads is coupled with no more than one of the nodes between the sense members, and is associated with one of the sense members. In addition, each pick-off pad is configured to cooperate with the second pad to produce an output signal representative of an attenuated version of the acoustic signal incident on the plurality of sense members.

The MEMS microphone may also include an integrated circuit configured to switch between receiving signals from the first output pad and the at least one pick-off pad. Moreover, those skilled in the art may select the appropriate number of pick-off pads. For example, the MEMS microphone could have only one pick-off pad, or a plurality of pick-off pads.

If implemented as a piezoelectric MEMS microphone, then its sense members may include piezoelectric sense members. Some embodiments may connect the plurality of sense members in series.

In accordance with other embodiments, a MEMS transducer system has a transducer configured to convert a received signal into a transducer signal, and an integrated circuit in communication with the transducer to receive the transducer signal. The transducer further includes a transducer ground node and, in a similar manner, the integrated circuit may have an IC ground node. The integrated circuit further has an output and is configured to process the received transducer signal to produce an IC output signal, which may be an AC signal, at the output. The transducer ground node illustratively is coupled with the integrated circuit output to receive the IC output signal. Accordingly, in preferred embodiments, the transducer ground node receives an attenuated and inverted version of the IC output signal.

To that end, illustrative embodiments may have a feedback segment electrically connecting the output of the integrated circuit with the transducer ground node. The feedback segment may have an amplifier configured to selectively amplify or attenuate the IC output signal.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a MEMS transducer can more effectively manage high-pressure input signals that otherwise may overly distort its output signal. This should help increase the well-known acoustic overload point ("AOP," discussed below) on an as-needed basis. To that end, in illustrative embodiments, the MEMS transducer has a gain controller/attenuator that attenuates the output signal before it is processed by downstream circuitry (e.g., a transducer ASIC). For example, the MEMS transducer may be part of a packaged microchip with a switched capacitor that selectively attenuates the noted output signal before it is processed by the downstream circuitry. Other embodiments may implement the attenuator so that it selectively receives only part of the signal from the MEMS transducer (e.g., from selected segments of a segmented diaphragm of the MEMS transducer).

Rather than using a switched capacitor, however, other embodiments using a MEMS transducer with multiple actuation members (e.g., multiple separate cantilevered members of a piezoelectric microphone, discussed below) may include an output pad at one or more of the actuation members. To manage a high-pressure event, the downstream circuitry may "pick-off" the signal from one or more of the actuation points rather than the conventional manner of using the sum of all of the actuation points. This reduces the overall signal into the circuitry, effectively managing the high-pressure event.

The inventors also found that coupling the ground/reference potential of the MEMS transducer to the AC output signal of its circuitry has a similar desired effect of increasing the AOP. Accordingly, in another embodiment, a feedback line electrically connects the output of the circuitry (e.g., an ASIC) with the ground node of the MEMS transducer to receive the AC output signal of the circuitry. In some embodiments, this signal received at the ground node is an inverted, attenuated version of the AC output signal.

Details of these and other embodiments are discussed below.

Figure 1:
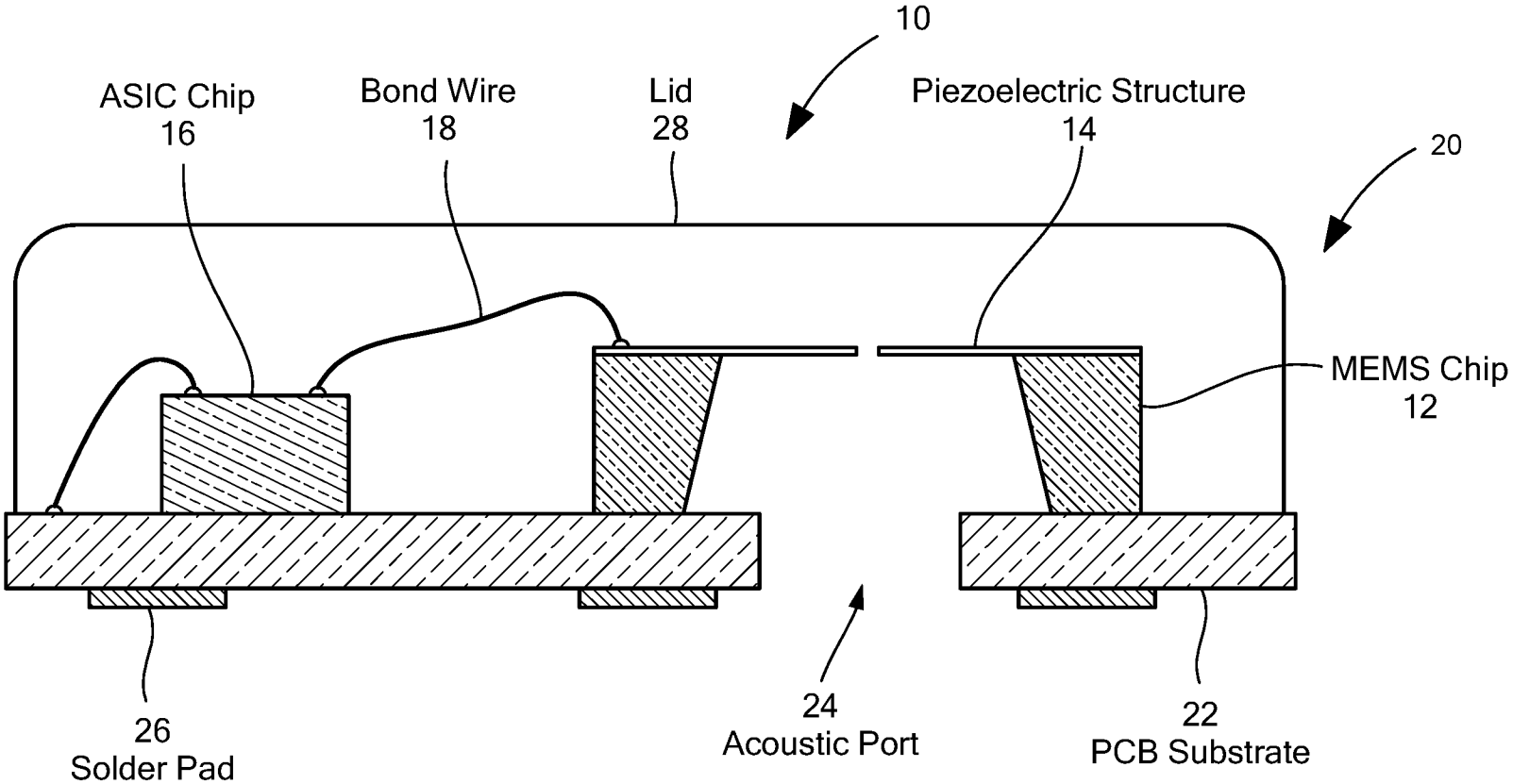
FIG. 1 schematically shows a cross-sectional view of a MEMS acoustic sensor that may implement illustrative embodiments of the invention.

FIG. 1 schematically shows an acoustic sensor implemented as a typical piezoelectric MEMS microphone 10 (also referred to as a "MEMS transducer 10"). As shown, the MEMS microphone 10 of FIG. 1 includes a MEMS chip 12 die having piezoelectric structures 14, e.g. cantilevers or diaphragms, to convert sound pressure into electrical signal, and an application-specific integrated circuit chip/die ("ASIC 16") to buffer and amplify the electrical signal generated by the MEMS chip 12. The MEMS and ASIC chips 12 and 16 are electrically connected by wire bonding 18, and mounted within the interior chamber of a package 20. Specifically, the package 20 has a substrate 22 (e.g., a printed circuit board) that forms an acoustic port 24 for enabling sound pressure to access the MEMS chip 12, and multiple solder pads 26 for users to solder the microphone package 20 onto their boards. A metal lid 28 is typically used to form the housing of the microphone and to mitigate electromagnetic interference (EMI).

As noted, the MEMS chip 12 may be formed from one or more piezoelectric cantilevers or diaphragms (discussed below). Cantilever based piezoelectric structure 14 is preferable in many cases as it typically is stress free after the die is released during fabrication. On the other hand, the diaphragm structure of such a microphone chip 12 typically requires more stress control in the fabrication process as minimal residual stress within the diaphragm can result in significant sensitivity degradation. Multiple cantilevers can be arranged to form a piezoelectric sensing structure, e.g. a square shape, a hexagon shape, an octagon shape, or some other shape.

Rather than implement the system with two separate chips, some embodiments may implement both the MEMS chip 12 and ASIC 16 of this and other embodiments as part of the same die. Accordingly, discussion of separate chips is for illustrative purposes.

Figure 2:
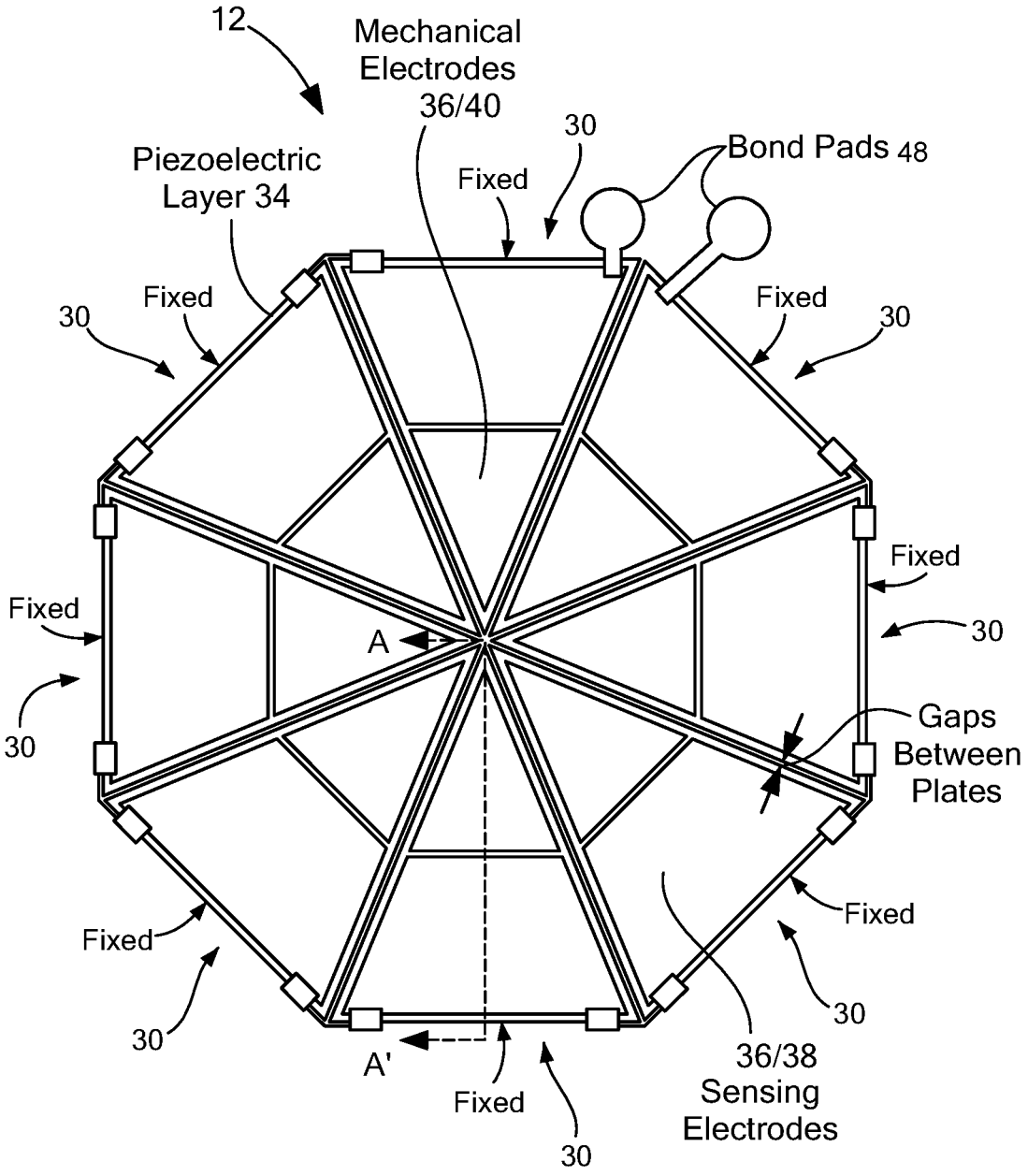
FIG. 2 schematically shows a plan view of a generic piezoelectric MEMS acoustic sensor die.
Figure 3:
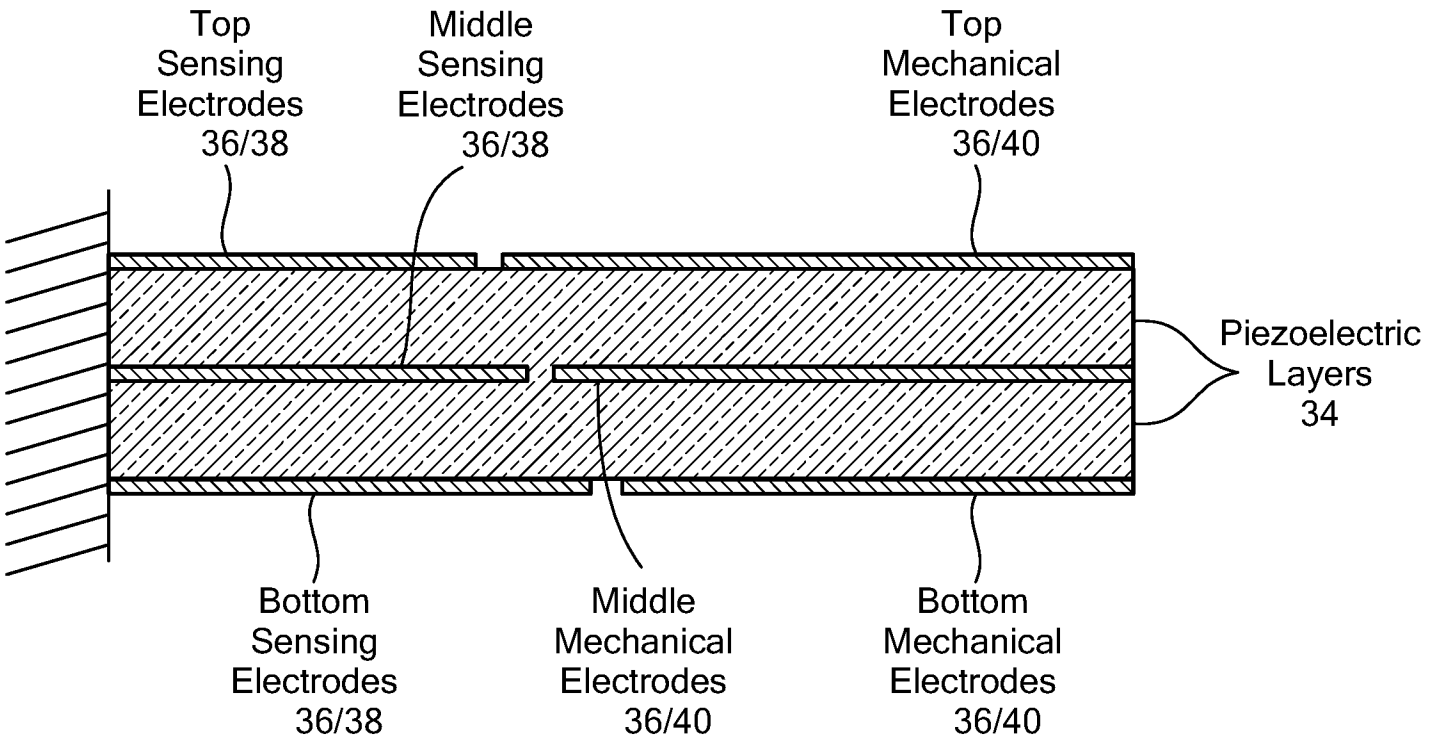
FIG. 3 schematically shows a cross-sectional view of a cantilever member of the MEMS acoustic sensor die across line A-A' of FIG. 2.

FIG. 2 schematically shows a plan view of an exemplary microphone chip 12 using eight sense members (also known as "sense arms") formed as piezoelectric triangular cantilevers 30. These members together form an octagonal MEMS acoustic sensor. FIG. 3 shows a cross-sectional view of one of those cantilevers 30. Indeed, some embodiments may use more or fewer cantilevers 30. Accordingly, as with other features, discussion of eight cantilevers 30 is for illustrative purposes only. These triangular cantilevers 30 are fixed to a substrate (e.g., a silicon substrate) at their respective bases and are configured to freely move in response to incoming/incident sound pressure (i.e., an acoustic wave). Triangular cantilevers 30 are preferable to rectangular ones as they form a gap controlling geometry. Specifically, when the cantilevers 30 bend up or down due to either sound pressure or residual stress, the gaps between adjacent cantilevers 30 typically remain relatively small.

The cantilever 30 can be fabricated by one or multiple layers of piezoelectric material sandwiched by top and bottom metal electrodes 36. FIG. 3 schematically shows an example of this structure. The piezoelectric layers 34 can be made by typical piezoelectric materials used in MEMS devices, such as one or more of aluminum nitride (AlN), aluminum scandium nitride (AlScN), zinc oxide (ZnO), and lead zirconate titanate (PZT). The electrodes 36 can be made by typical metal materials used in MEMS devices, such as one or more of molybdenum (Mo), platinum (Pi), nickel (Ni) and aluminum (Al). Alternatively, the electrodes 36 can be formed from a non-metal, such as doped polysilicon. These electrodes 36 can cover only a portion of the cantilever 30, e.g., from the base to about one third of the cantilever 30, as these areas generate electrical energy more efficiently within the piezoelectric layer 34 than the areas near the free end. Specifically, high stress concentration in these areas near the base induced by the incoming sound pressure is converted into electrical signal by direct piezoelectric effect.

The electrodes 36 are generally identified by reference number 36. However, the electrodes used to sense signal are referred to as "sensing electrodes" and are identified by reference number 38. These electrodes are preferably electrically connected in series to achieve the desired capacitance and sensitivity values. In addition to the sensing electrodes 38, the rest of the cantilever 30 also may be covered by metal to maintain certain mechanical strength of the structure. However, these "mechanical electrodes 40" do not contribute to the electrical signal of the microphone output.

Although the figures and this description discuss the piezoelectric MEMS acoustic sensor in great detail, those skilled in the art can apply various embodiments to other types of transducers. For example, various embodiments may apply to general inertial sensors, such as accelerometers and gyroscopes, pressure sensors, tilt sensors, speakers, chemical sensors, and/or ultrasonic transducers, and other types of sensors. Accordingly, detailed discussion of a piezoelectric MEMS acoustic sensor is primarily for illustrative purposes and not intended to limit various other embodiments of the invention.

Transducers (e.g., acoustic sensors) have specifications for acoustic parameters and electrical interface. Among others, those acoustic specifications typically include sensitivity, signal-to-noise ratio, acoustic overload point (AOP, noted above), and total harmonic distortion. Electric specifications include, among other things, supply voltage range, supply current, output impedance, and power supply rejection. Each specification has conditions under which the parameter is tested and characterized.

For instance, signal-to-noise ratio (SNR) in certain transducers typically is specified as the ratio of the signal sensitivity measured with a 94 dBSPL, 1 kHz sine wave acoustic signal, and the A-weighted output noise integrated from 20 Hz to 20 kHz. Equivalent Input Noise, (EIN), which is a measure of the noise floor in sound pressure level, generally is defined as 94 dBSPL−SNR. The specification for AOP is typically defined as the sound pressure level in which a 1 kHz sine wave acoustic input causes 10 percent distortion at the output of the acoustic sensor. As yet another example, the dynamic range, (DR) or the range of sound pressure levels the acoustic sensor can sense, is defined as: DR=AOP-EIN.

Adhering to some of these specifications, however, can produce performance problems. Illustrative embodiments address and mitigate problems with the stringent requirement for AOP. This can have a number of useful applications.

For example, in the Internet-of-Things (IoT) application space, smart speakers have become a ubiquitous product offering. Many of these speakers are beginning to provide voice user interface (VUI) as the user interface of choice. As a result, performance of the acoustic sensor (e.g., the microphone 10) is increasingly important to ensure a consistent user experience. With a smart speaker application, the microphone 10 operates in a complicated acoustic environment, where outside acoustic interferes, i.e., other speakers, appliances, people, etc. could affect the VUI experience. Making matters worse, other internal factors, such as speaker output, internal vibrations, mechanical coupling, etc., also add to this problem. To the knowledge of the inventors, relatively high nonlinearity in the speaker/microphone system makes it more difficult for smart speakers to sense/hear that a user that is trying to use the voice interface.

Recognizing this problem, the inventors discovered that they could program and configure the AOP, permitting a higher bass response of the noted smart speaker implementing the microphone 10 of various embodiments. Specifically, the inventors recognized that by increasing the AOP level, the bass response does not necessarily saturate or distort the sensor output. Accordingly, using this technique, the inventors recognized that they could maintain the acoustic performance necessary to preserve the VUI experience.

For hearable-type products within the IoT space, wind noise becomes a concern for saturating the acoustic sensor, or microphone output. Wind noise is typically a low frequency signal and has a $1/f^2$ spectrum in the frequency domain, while energy for wind noise is normally in the <1 Hz to 100 Hz band. The inventors recognized that a hearable application that enables dynamic control of the AOP should provide optimal microphone performance in the presence of wind noise.

Figure 4:
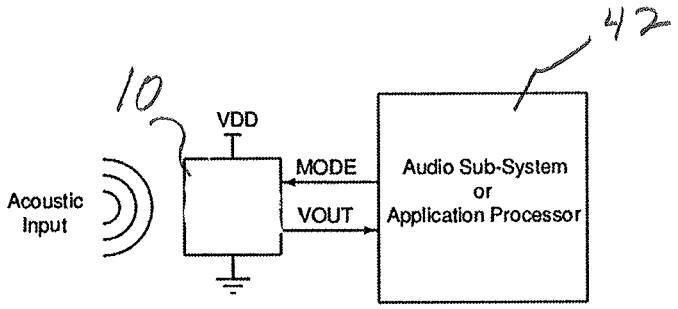
FIG. 4 schematically shows a system interface configured in accordance with illustrative embodiments of the invention.

To those ends, the transducer system (i.e., the microphone system 10) may be selected/switched into one of two different modes. The first mode may be a "standard" mode, which is essentially the same as current state of the art transducers. The second mode may be a "lower sensitivity mode," in which the sensitivity of the signal either produced by the transducer or fed into the ASIC 16 is reduced. This mode may be adjustable (e.g., at test or trim) to satisfy the requirements of an application and the transducer. For example, when in this second mode, the transducer 12 may be configured to be 20 dB less sensitive, thus ideally enabling it to handle 20 dB more input pressure. FIG. 4 schematically shows an exemplary system interface for such an application in accordance with illustrative embodiments. In this example, an audio sub-system or application processor (both generically identified by reference number "42") simply modes/switches the acoustic sensor into a "high AOP" mode (i.e., the noted second, lower sensitivity mode") by toggling a mode pin to a first voltage (e.g., a high voltage, such as VDD). Conversely, the acoustic sensor 10 is in the normal acoustic mode (i.e., the noted first, normal mode) by driving a mode pin or similar interface to another voltage (e.g., a low voltage, such as ground).

Figure 5:
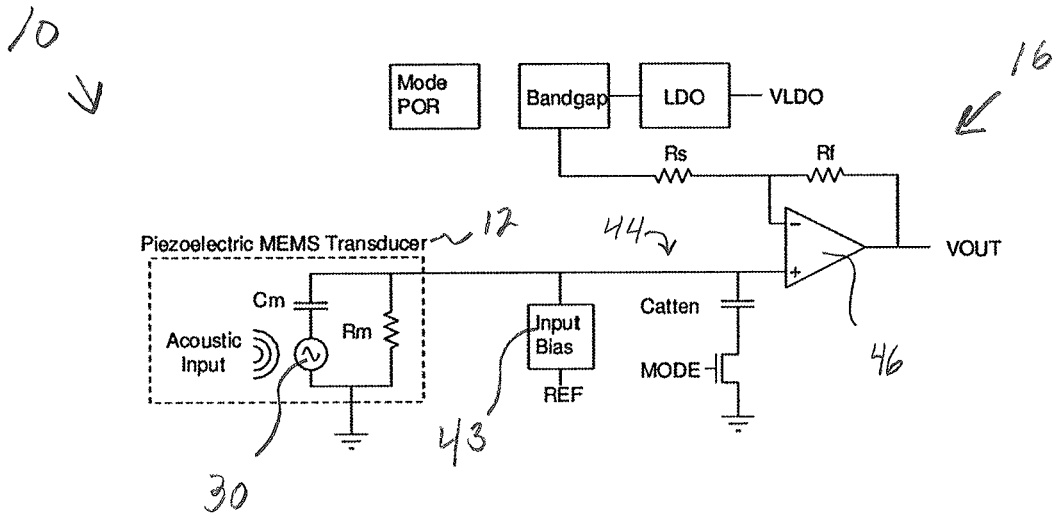
FIG. 5 schematically shows the transducer system of FIG. 1 configured in accordance with one embodiment of the invention.

As noted above, to implement the lower sensitivity mode, one embodiment has a gain controller/attenuator 41 that attenuates the output signal before it is processed by the ASIC 16. Specifically, FIG. 5 schematically shows an architecture for the ASIC 16 to interface to a piezoelectric acoustic sensor in accordance with illustrative embodiments. As shown, the ASIC 16 has an input node 44 at the non-inverting terminal of an operational amplifier 46. The output of the operational amplifier 46 also serves as the output of the ASIC 16. Additional circuitry, such as the resistors and other elements, further process the output signal of the MEMS microphone 10. Thus, the output voltage of the piezoelectric MEMS transducer 10 is fed into the non-inverting terminal of the operational amplifier 46, which is configured as a voltage amplifier.

The gain of the operational amplifier 46 is set by the resistors $R_f$ and $R_s$ and as configured in FIG. 5 is represented by Equation 1 below:

$$A_V = 1 + \frac{R_f}{R_s} \qquad \text{Equation 1}$$

The output voltage of the operational amplifier 46 is given in Equation 2, below, in the Laplace Domain, where $s=i\omega$, assuming the effective impedance through an input bias block 43 is $R_{IN}$, the input capacitance of the operational amplifier 46 is given as $C_{IN}$, and ignoring $C_{Atten}$. $C_M$ is the capacitance of the piezoelectric transducer, as well as any stray capacitance on the MEMS die, and any package parasitic capacitance. $C_{in}$ is the input capacitance of the ASIC 16 and is comprised of capacitance from ESD structures, biasing structures, FET gate capacitances, and layout parasitic capacitances.

$$V_{out} = V_{IN}\left[\frac{sC_M(R_{IN}\|R_M)}{1|s(C_M|C_{IN})(R_{IN}\|R_M)}\right]\left[1 + \frac{R_f}{R_s}\right] \qquad \text{Equation 2}$$

The output voltage is trimmed to a set sensitivity at test by adjusting the value of $R_F$. This may be accomplished through a digital interface and an array of resistors to tune the value of $R_F$ and thus, tune the gain of the circuit to achieve a desired sensitivity for the acoustic sensor.

The input bias structure 43 shown in FIG. 5 biases the non-inverting input of the operational amplifier 46 for optimal performance, and balances the leakage across $R_M$ of the piezoelectric MEMS transducer 10.

FIG. 5 thus shows a circuit with the MEMS piezoelectric microphone 12, an input bias structure 43, a voltage amplifier 46, and a capacitance $C_{Atten}$ connected to the input (i.e., on the same node 44). The capacitance, $C_{Atten}$, attenuates the signal as it forms a voltage divider with the capacitance of the piezoelectric transducer and the input capacitance of the ASIC 16. The level of attenuation can be set by Equation 3.

$$V_{out} - V_{IN}\left[\frac{sC_M(R_{IN}\|R_M)}{1 + s(C_M + C_{IN} + C_{Atn})(R_{IN}\|R_M)}\right]\left[1 + \frac{R_f}{R_s}\right] \qquad \text{Equation 3}$$

The level of attenuation achieved by the addition of Marten can be tuned at test. Although only one switched capacitor attenuator 41 is shown, the actual capacitance (i.e., attenuator 41) may be realized as an array of capacitors, which can be configured at test by a digital interface, to switch in the appropriate value of capacitance to achieve the desired attenuation. The array of capacitors can be realized in several manners, i.e. binary weighted, linearly weighted, or even centered around certain, pre-determined attenuation levels prior to manufacturing. Memory can store a multi-bit word indicating which capacitors in the array may be active during operation in the second mode.

The ASIC 16 thus has the noted normal acoustic mode, which may have an industry standard −38 dBV output sensitivity that is trimmed by an adjustable feedback resistor, $R_F$. The amplifier output stage saturation levels set the overall AOP, defined as the acoustic input that causes 10 percent distortion at the amplifier output. For a −38 dBV sensitive microphone, a typical AOP could be 127 dBSPL.

To switch to the lower sensitivity/high AOP mode, logic switches on the desired capacitor(s) to the input node 44 of the ASIC 16 (e.g., using the MODE transistor), where the piezoelectric MEMS transducer 10 is interfaced. This capacitance attenuates the input signal per Equation 2. This capacitance can be one time programmed or configured by digital control to set dynamically the amount of attenuation desired. For example, a piezoelectric MEMS transducer 10 with a capacitance of 1.5 pF and interfaced to an ASIC 16 producing −38 dBV sensitivity and 127 dBSPL AOP may be configured by switching a 13.5 pF capacitor/capacitance on to the input node 44 to have a −58 dBV sensitivity, achieving an AOP of 147 dBSPL.

Moreover, the ASIC 16 has additional components known by those skilled in the art, some of which are shown in FIG. 5. For example, FIG. 5 shows a power-on-reset block ("POR") that generates a reset signal and powers up the blocks in a specific order so that the ASIC 16 is in a specific state upon power-up. This POR block also may be executed when the mode is changed and thus, it often is referred to as "Mode POR." The "Bandgap" block acts as a bandgap reference, which generates a reference voltage that preferably does not change with temperature or process variation. This reference voltage is then used wherever a known, constant voltage is needed. One example of this would be the low drop-out block ("LDO"), which essentially acts as a voltage regulator that takes the supplied voltage (VDD) and regulates it down to a constant voltage (VLDO) used to power most blocks in the ASIC 16.

Indeed, it should be emphasized that many of these values and blocks are exemplary and thus, not intended to limit various embodiments.

Other embodiments may employ other techniques for implementing the attenuator 41 to obtain a similar, selectively higher AOP benefit. Specifically, the MEMS transducer 10 of FIG. 1, for example, which has multiple actuation members (e.g., multiple separate cantilevered members of a piezoelectric microphone), may include an output pad 48 at one or more of the individual actuation members. In other words, some or all of the individual cantilevered members each may be electrically coupled with a "pick-off" pad 48 dedicated to that actuation member. For example, a MEMS transducer 10 with first through eighth actuation members (i.e., cantilevers 30) may have a first actuation pad 48 coupled with the first actuation member 30, a second actuation pad 48 coupled with the second actuation member 30, a third actuation pad 48 coupled with the third actuation member 30, etc. As similar example, only some of the actuation members 30 may have their own pick-off pads 48, while in others, only one may have its own pick-off pad 48.

Those skilled in the art may select the specific configuration based on the anticipated applications of the MEMS transducer 10.

Accordingly, to manage a high-pressure event, the ASIC 16 may selectively "pick-off" the signal from one or more of the pads/actuation points 48 rather than the conventional manner of using the sum of all of the actuation points (e.g., using the right two bond pads 48 in the figure). Acting as the attenuator 41, this arrangement reduces the overall signal transmitted into the microphone circuitry of the integrated circuit, effectively managing the high-pressure event and increasing the AOP.

Figure 6A:
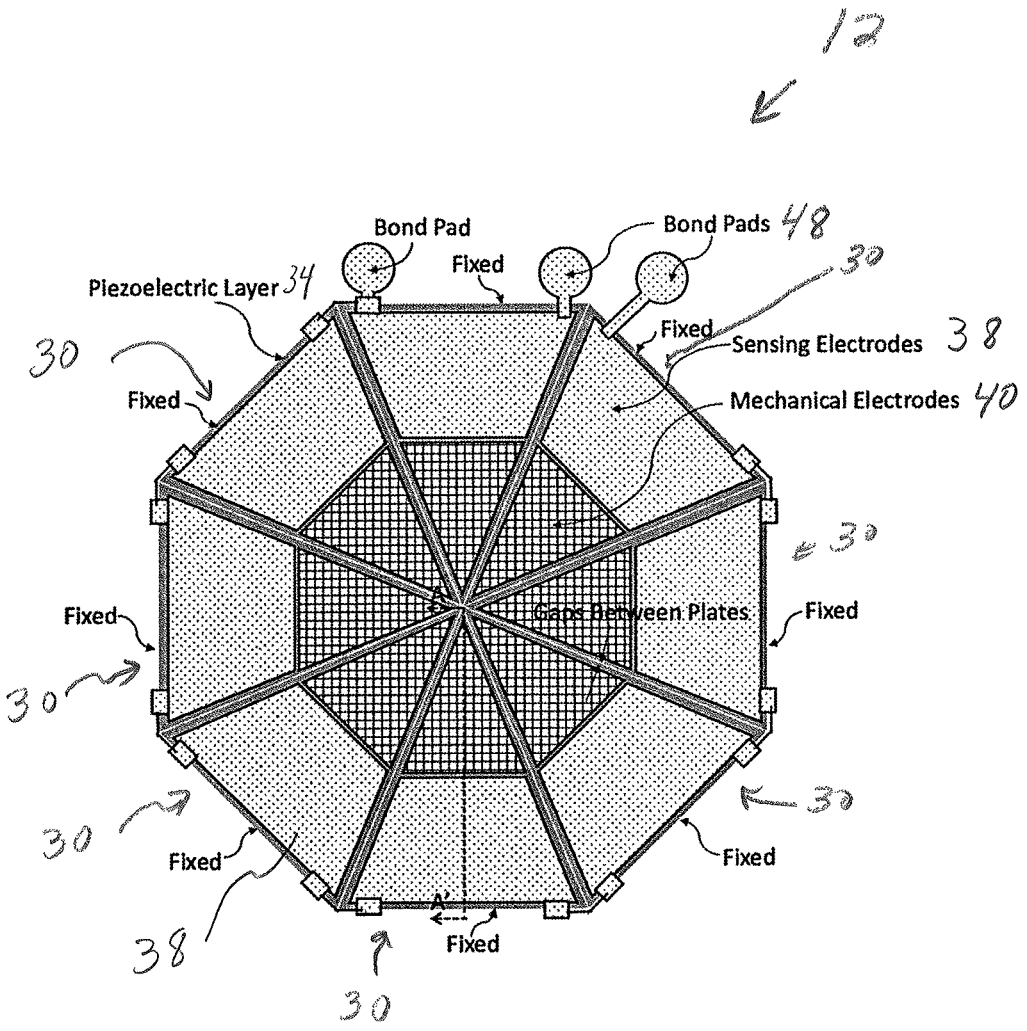
FIG. 6A schematically shows a MEMS transducer configured in accordance with another embodiment of the invention.
Figure 6B:
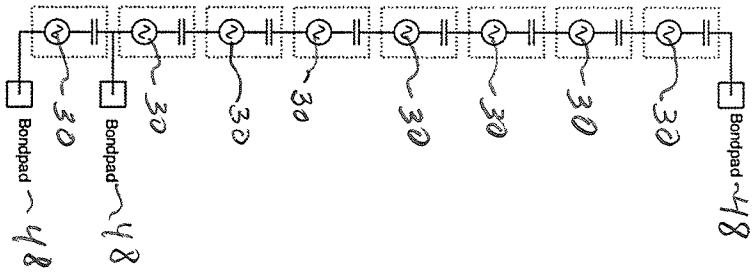
FIG. 6B schematically shows an electrical diagram representing the MEMS transducer of FIG. 6A.

More particularly, FIG. 6A shows an alternative embodiment of the MEMS microphone 10 of FIG. 2. In this embodiment, the microphone has one or more additional bond pad(s) 48 to produce a low sensitivity output of the microphone chip 12. FIG. 6B schematically shows this embodiment in an electrical diagram. Specifically, FIG. 6B is realized by traversing the periphery of the microphone chip 12 in a counterclockwise direction with the middle bond pad 48 (of the three bond pads 48 shown) in the figure described as the "first additional bond pad 48." As shown, the electrodes 36 are wired in series, producing a normal sensitivity output between the "picked-off" pad 48 and the bottom pad 48 (from the perspective of the figure). Also note that the capacitance shown in FIG. 6B simply is that produced by the electrodes 36.

Accordingly, using the diagram of FIG. 6B, the additional pick-off bond pads 48 can be considered to be on the nodes between two cantilevered members 30 and, as such, associated with at least one of those members 30. Thus, using the bottom pad 48, if the signal is "picked-off" at the first additional bond pad 48 (i.e., the middle bond pad 48) and measured with the picked-off pad 48 and the bottom bond pad 48, the sensitivity will be cut to ⅛th the sensitivity when compared to using all the electrodes 36. This favorably increases the AOP by about eight times as a result of the sensitivity reduction. In other words, in this embodiment, only one of the cantilevered members 30 contributes to the output signal of the MEMS microphone 10.

In fact, as discussed above, more than one cantilevered member 30 can have a similar additional bond pad 48. Each such additional bond pad 48 can act as a port for forwarding an output signal produced by its member only. These individual MEMS output signals could be sensed individually by the ASIC 16, which may be designed to interface to this MEMS design, or switched by user input, automation logic (e.g., a smart speaker that senses a high pressure event), or a threshold detection circuit on the ASIC 16 to automatically switch in the presence of a high sound pressure level input. The signals could also be sensed in parallel and combined, increasing the overall dynamic range of the acoustic sensor 10. System design would ensure that the analog-to-digital converters and signal processing chain can accept the wider dynamic range acoustic sensor output.

Some embodiments may divide the cantilevered members 30 further to accomplish finer results. For example, some embodiment may divide one or more of the cantilevered members 30 to form smaller cantilevered members 30 and, among other sizes, those smaller cantilevered members 30 may be ⅓ or ⅔ the size of the current cantilevered members 30.

Another technique to control the AOP uses a feedback arm 50 that feeds a portion of the output voltage back onto the MEMS transducer 10 to reduce the sensitivity. This technique is similar to that known in the art as "bootstrapping." This beneficially increases the reference/ground potential of the transducer chip 12, while maintaining the same reference/ground potential for the ASIC 16. In illustrative embodiments, the ASIC ground is higher than that of the transducer chip 12, although other embodiments may use the same reference/ground potential.

Figure 7:
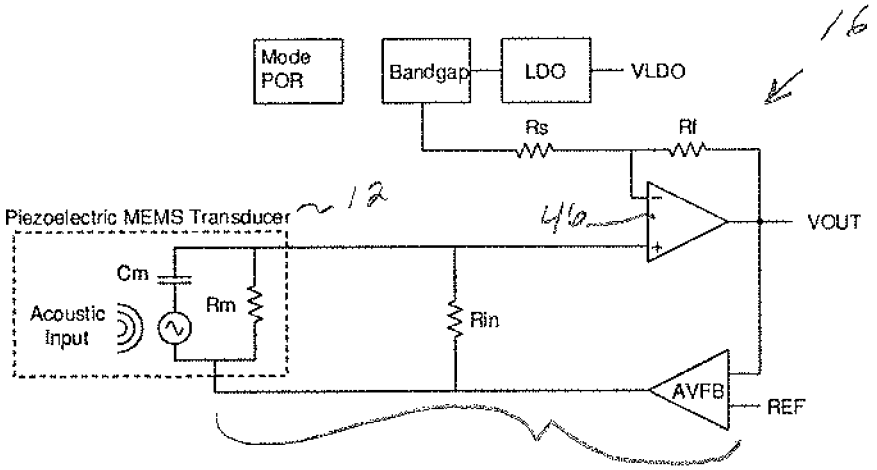
FIG. 7 schematically shows the transducer system of FIG. 1 configured in accordance with yet another embodiment of the invention.

FIG. 7 shows one technique for accomplishing this result in which a portion of the output voltage, $V_{OUT}$, is driven on to the back side of the piezoelectric MEMS transducer 10—the location of ground in the embodiment of FIG. 5. This provides the input/output voltage characteristic given in Equation 4 below.

$$V_{out} = V_{IN}\left[\frac{\dfrac{sC_M(R_{IN}\|R_M)}{1+sC_M(R_{IN}\|R_M)}\left(1+\dfrac{R_f}{R_s}\right)}{1-A_{vfb}\left(1+\dfrac{R_f}{R_s}\right)}\right] \quad \text{Equation 4}$$

Figure 8:
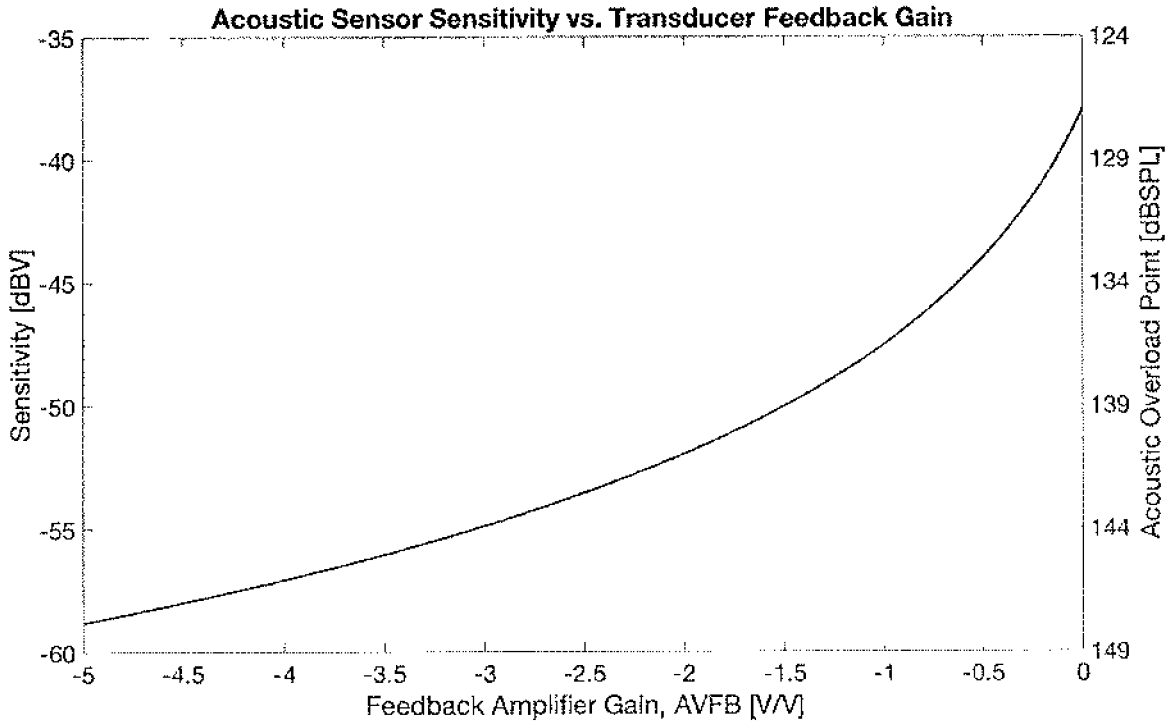
FIG. 8 graphically shows an example of acoustic sensor sensitivity and equivalent acoustic overload point vs. closed loop gain of the feedback operational amplifier of various embodiments.

Following Equation 4, by varying the closed loop gain of the $A_{VFB}$ amplifier, either through a trimming resistor similar to $R_F$, or some other means of gain configuration, the total output sensitivity of the circuit can be set according to curve in FIG. 8. Some embodiments may use this technique for another port of the MEMS transducer 10 other than the ground port.

Accordingly, various embodiments may configure the MEMS transducer chip 12, ASIC 16, and/or other portions of the transducer system 10, to more effectively manage high-pressure events.

The embodiments of the invention described above are intended to be merely exemplary; numerous variations and modifications will be apparent to those skilled in the art. Such variations and modifications are intended to be within the scope of the present invention as defined by any of the appended claims.

What is claimed is:

1. A MEMS transducer system comprising:

a transducer comprising a plurality of sense members configured to independently move in response to a pressure signal to produce a plurality of member signals, the transducer further including an output port for forwarding at least one of the member signals;

an integrated circuit having an IC input in electric communication with the transducer output port, the IC input being configured to receive an IC input signal that is produced as a function of the at least one of the member signals; and an attenuator coupled between the IC input and the transducer output port, the attenuator being electrically coupled with at least one of the sense members, the attenuator being configured to selectively electrically couple fewer than all of the member signals with the IC input, the attenuator being selectably actuatable and configured to selectively attenuate one or more member signals into the IC input to at least in part produce an attenuated IC input signal, the attenuator being integral with the integrated circuit or separate from the integrated circuit.

2. The MEMS transducer system of claim 1 wherein the attenuator comprises a dividing element coupled between the IC input and the transducer output port, the dividing element being selectably actuatable.

3. The MEMS transducer system of claim 2 wherein the dividing element includes at least one attenuation branch, each attenuation branch having a switch and a capacitance in series with the switch.

4. The MEMS transducer system of claim 2 wherein the dividing element includes a plurality of attenuation branches that each have a switch and a capacitance in series with the switch.

5. The MEMS transducer system of claim 4 wherein the integrated circuit has a mode pin configured to actuate at least one attenuation branch in response to receipt of a first signal, and to disable the at least one attenuation branch in response to receipt of a second signal.

6. The MEMS transducer system of claim 4 further comprising memory storing information for selectably actuating prescribed attenuation branches.

7. The MEMS transducer system of claim 1 wherein the transducer comprises at least one of a microphone, speaker, accelerometer, gyroscope, inertial sensor, tilt sensor, chemical sensor, pressure sensor, and/or ultrasonic transducer.

8. The MEMS transducer system of claim 1 wherein the transducer comprises a piezoelectric MEMS microphone.

9. The MEMS transducer system of claim 1 wherein the integrated circuit comprises an application specific integrated circuit with an operational amplifier having a non-inverting input and an op-amp output, the IC input being coupled with the non-inverting input, the IC having an output coupled with the op-amp output.

10. The MEMS transducer system of claim 1 wherein a node connects the IC input and transducer output port, the attenuator being coupled with the node and electrically in parallel with the transducer output port.

11. The MEMS transducer system of claim 1 wherein the transducer and integrated circuit each are formed on different dies.

12. A MEMS transducer system comprising:

a MEMS transducer configured to convert a received signal into a transducer signal, the transducer further including a transducer ground node;

an integrated circuit in communication with the MEMS transducer to receive the transducer signal, the integrated circuit having an output and configured to process the received transducer signal to produce an IC output signal at the output, the transducer ground node being coupled with the integrated circuit output to receive the IC output signal.

13. The MEMS transducer of claim 12 further having a feedback segment electrically connecting the output of the integrated circuit with the transducer ground node.

14. The MEMS transducer of one claim 13 wherein the feedback segment has an amplifier configured to selectively amplify or attenuate the IC output signal.

15. The MEMS transducer system of claim 12 wherein the MEMS transducer comprises at least one of a microphone, speaker, accelerometer, gyroscope, inertial sensor, tilt sensor, chemical sensor, pressure sensor, and/or ultrasonic transducer.

16. The MEMS transducer system of claim 12 wherein the MEMS transducer comprises a piezoelectric MEMS microphone.

17. The MEMS transducer system of claim 12 wherein the MEMS transducer and integrated circuit each are part of the same die.

18. The MEMS transducer system of claim 12 wherein the MEMS transducer and integrated circuit each are formed on different dies, the transducer system further including a package forming a chamber containing the MEMS transducer and the integrated circuit.

* * * * *